US010780957B2

(12) United States Patent
LaPosta et al.

(10) Patent No.: US 10,780,957 B2
(45) Date of Patent: Sep. 22, 2020

(54) BOARD-TYPE WATERCRAFT

(71) Applicant: Allied Resin Technologies LLC, Leominster, MA (US)

(72) Inventors: Daniele LaPosta, Medford, MA (US); Edward O. Mazzaferro, Tiverton, RI (US); Elliot Feinberg, Leominster, MA (US)

(73) Assignee: ALLIED RESIN TECHNOLOGIES LLC, Leominster, MA (US)

( * ) Notice: Subject to any disclaimer, the term of this patent is extended or adjusted under 35 U.S.C. 154(b) by 0 days.

(21) Appl. No.: 16/038,722

(22) Filed: Jul. 18, 2018

(65) Prior Publication Data

US 2019/0144086 A1 May 16, 2019

Related U.S. Application Data

(60) Provisional application No. 62/648,451, filed on Mar. 27, 2018, provisional application No. 62/584,479, filed on Nov. 10, 2017.

(51) Int. Cl.
*B63B 32/80* (2020.01)
*B63B 32/53* (2020.01)

(52) U.S. Cl.
CPC ..... *B63B 32/80* (2020.02); *B63B 32/53* (2020.02)

(58) Field of Classification Search
CPC ..... B63B 35/73; B63B 35/79; B63B 35/81; B63B 35/00; B63B 7/00; B63B 7/02; B63B 7/04; B63B 35/7916; B63B 35/7946
USPC ..... 114/352; 441/74
See application file for complete search history.

(56) References Cited

U.S. PATENT DOCUMENTS 3,287,754 A * 11/1966 Price ..... B63B 35/7916 441/74
5,711,692 A * 1/1998 Pope ..... B63B 35/7916 114/352
7,121,909 B1 * 10/2006 Meyerhoffer ..... B63B 35/7916 441/74
7,390,234 B2 * 6/2008 Peach ..... B63B 35/7916 114/352
8,469,756 B2 * 6/2013 Becker ..... B63B 35/7916 114/352
2015/0307165 A1 * 10/2015 Patton ..... B63B 35/7916 441/74

* cited by examiner

*Primary Examiner* — Lars A Olson
(74) *Attorney, Agent, or Firm* — Kriegsman & Kriegsman

(57) ABSTRACT

A board-type watercraft is adapted for selective disassembly into a plurality of separate sections for ease of transport and storage. Preferably, a selection of differently configured nose and tail sections can be releasably connected to a universal middle section to create a wide variety of distinctive board styles. With the watercraft in its assembled state, adjacent sections are releasably secured together using compressive-type fastening elements, such as spring-biased latch mechanisms. Pairs of fastening elements are preferably arranged on the top and bottom surfaces of the board in substantial vertical alignment to limit torque between sections and thereby ensure adequate stiffness through each joint. In its disassembled state, the sections can be stacked into a highly compact configuration suitable for packaging within a container that is compliant with maximum size standards for conventional ground courier services.

10 Claims, 5 Drawing Sheets

BOARD-TYPE WATERCRAFT

FIELD OF THE INVENTION

The present invention relates generally to watercrafts and, more particularly, to watercrafts designed for selective disassembly into a plurality of separate sections for ease of transport and storage.

BACKGROUND OF THE INVENTION

Board-type watercrafts, such as surfboards and stand-up paddle boards (SUPs), are well known in the art and are widely utilized in a variety of water-based leisure activities.

Commonly, board-type watercrafts are shaped or molded using one or more polymer materials, such polyurethane foam treated with a polyester or epoxy resin. The resultant board has an elongated, unitary construction with a relatively flat top surface designed to support the rider, a relatively flat, low friction, bottom surface, a narrow or pointed front end, or nose, and a widened rear end, or tail. To facilitate control of the board on water, a fin is often provided that projects outwardly from its bottom surface near its tail end.

Although designed primarily for use by a single rider, board-type watercrafts of the type as described above are nonetheless relatively large in size. For instance, a conventional stand-up paddle board is often approximately 7-14 feet in length, approximately 27-32 inches in width, and approximately 4-6 inches thick. As a result, the routine transport and storage of such items has been found to be relatively challenging. In fact, designated accessories, such as racks, are typically required in order to transport and store such boards.

Accordingly, an increasing number of watercrafts have been recently designed that are adapted for selective disassembly into a plurality of separate sections for greater ease of transport and storage. For example, a canoe with multiple releasable sections is described in U.S. Patent Application Publication No. 2016/0194061 to R. Ohman et al., the disclosure of which is incorporated herein by reference. As another example, a stand-up paddle board with a modular construction is currently available for sale by Point 65 Sweden AB, of Solna, Sweden, under its Rum Runner line of stand-up paddleboards. Lastly, a modular stand-up paddle board is currently available for sale by Riot Stand-Up Paddleboards of St. Hubert, Canada, under its Hydra line of stand-up paddleboards.

Separable, or modular, board-type watercrafts typically include adjacent sections with opposing mating faces that releasably engage to form a near seamless joint region. At least one fastening mechanism, such as a serrated strap and complementary locking buckle, is used to secure together the adjacent sections through the application of a suitable compressive force. Typically, one fastening mechanism is located along each outer side edge of the watercraft (i.e. with the fastening mechanisms disposed in a side-by-side relationship) to secure together the separate modules through each joint.

Although well known in the art, modular board-type watercrafts of the type as described above have been found to suffer from a few notable shortcomings.

As a first shortcoming, separable board-type watercrafts often lack the requisite rigidity and stability required to effectively engage in water-based activities. Specifically, it has been found that a certain undesirable degree of torque is experienced through each joint due to the number, style and arrangement of fastening mechanisms. This level of torque creates instability in the board that often renders it difficult to operate.

As a second shortcoming, although separable, the individual sections of such watercrafts are often relatively bulky in size and lack a flat, streamlined construction. As a consequence, these boards, when assembled, are generally not aesthetically pleasing. Additionally, these boards, when disassembled, are often incapable of being effectively arranged into a compact package, thereby precluding transport via smaller automobiles and shipment via conventional ground courier services.

SUMMARY OF THE INVENTION

It is an object of the present invention to provide a new and improved board-type watercraft.

It is another object of the present invention to provide a new and improved board-type watercraft that is adapted for selective disassembly into a plurality of separate sections.

It is yet another object of the present invention to provide a board-type watercraft of the type as described above that, when in its assembled state, remains rigid and stable to ensure effective operability.

It is still another object of the present invention to provide a board-type watercraft of the type as described above that, when in its assembled state, is aesthetically pleasing and closely resembles the look and feel of a conventional single-piece board.

It is yet still another object of the present invention to provide a board-type watercraft of the type as described above that, when in its disassembled state, can be arranged into a compact configuration to allow for ease of storage and transport as well as shipment via traditional ground courier services.

It is even yet still another object of the present invention to provide a board-type watercraft of the type as described above that has a limited number of parts, is inexpensive to manufacture, and is easy to use.

Accordingly, as a feature of the present invention, there is provided a watercraft adapted for arrangement between an assembled state and a disassembled state, the watercraft comprising (a) a plurality of separate sections, the plurality of separate sections comprising first and second sections that are joined together through a first joint when the watercraft is in its assembled state, and (b) a plurality of compressive-type fastening elements for securing the first and second sections together when the watercraft is in its assembled state, the plurality of compressive-type fastening elements comprising a first pair of fastening elements arranged in substantial vertical alignment with one another.

Various other features and advantages will appear from the description to follow. In the description, reference is made to the accompanying drawings which form a part thereof, and in which is shown by way of illustration, an embodiment for practicing the invention. The embodiment will be described in sufficient detail to enable those skilled in the art to practice the invention, and it is to be understood that other embodiments may be utilized and that structural changes may be made without departing from the scope of the invention. The following detailed description is therefore, not to be taken in a limiting sense, and the scope of the present invention is best defined by the appended claims.

BRIEF DESCRIPTION OF THE DRAWINGS

In the drawings, wherein like reference numerals represent like parts.

DETAILED DESCRIPTION OF THE INVENTION

Board-Type Watercraft 11

Figure 1A:
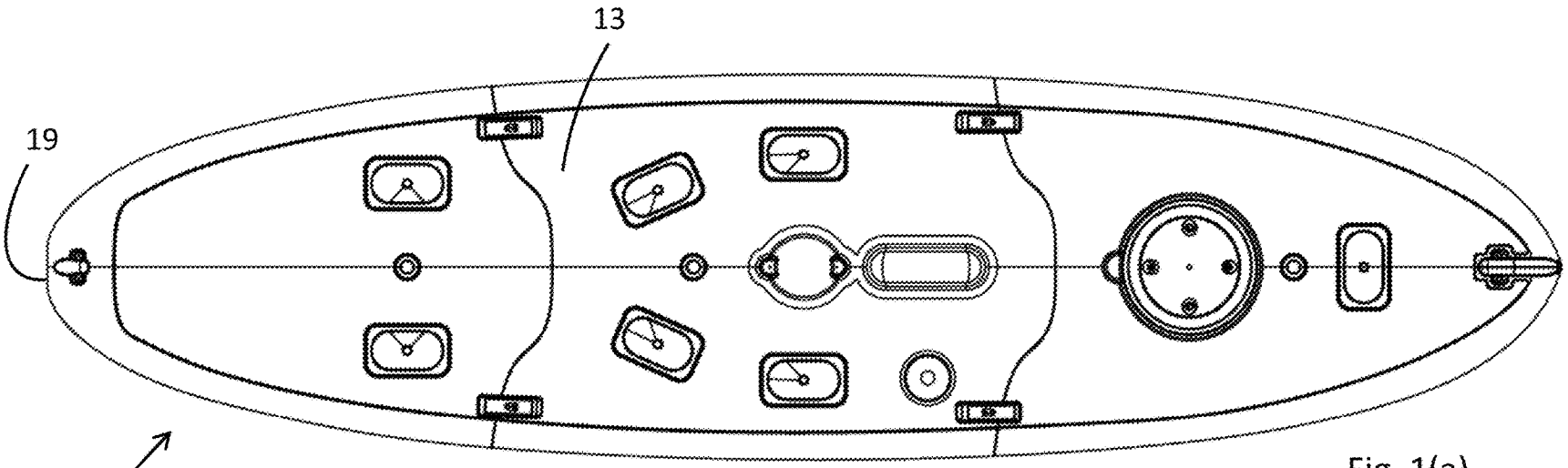
FIGS. 1(*a*)-(*d*) are top plan, bottom plan, top perspective and bottom perspective views, respectively, of a board-type watercraft constructed according to the teachings of the present invention, the board being shown in its fully assembled state.
Figure 1B:
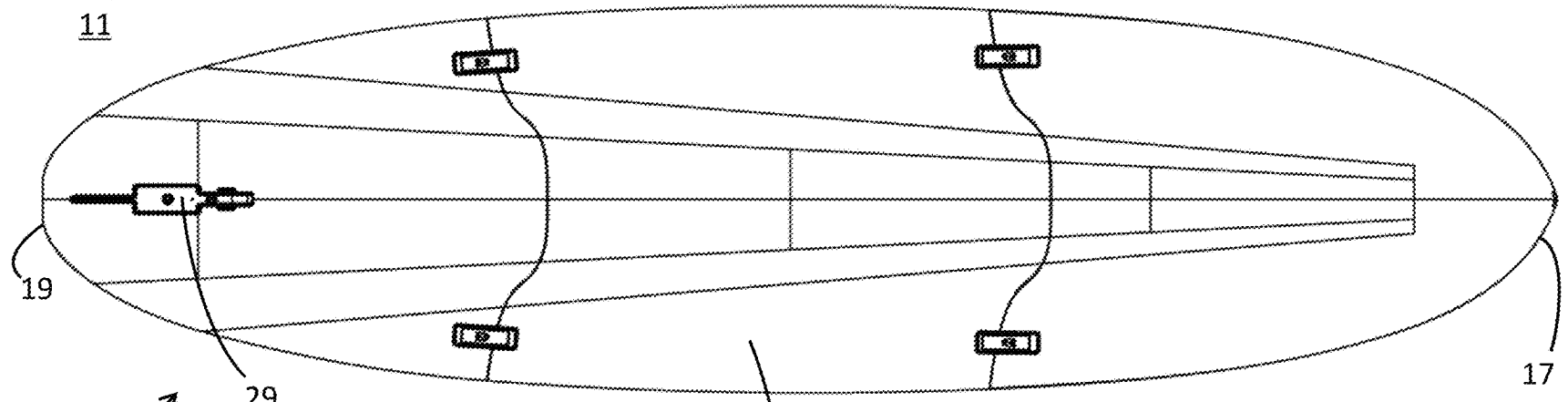
Figures 1C, 1D:
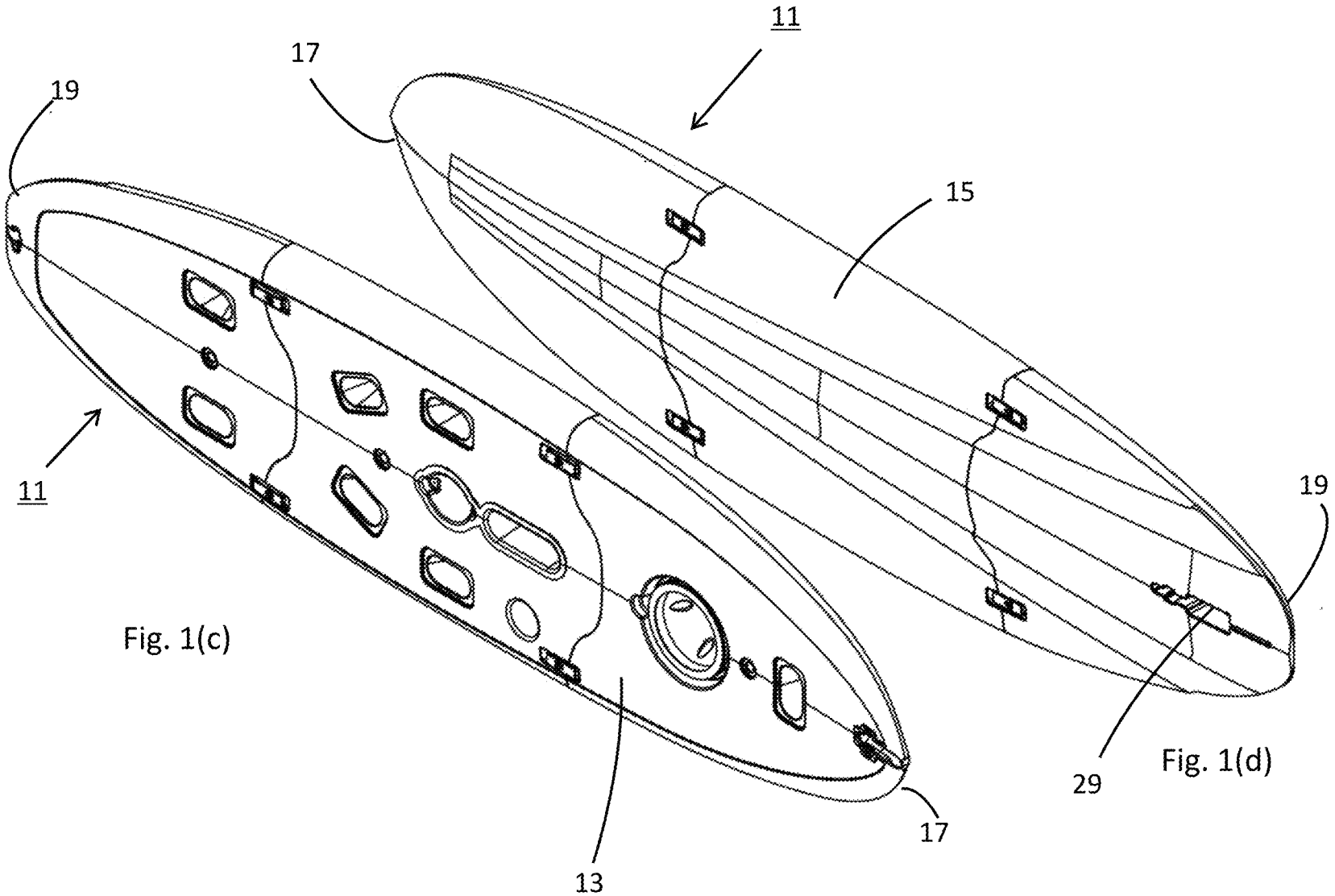

Referring now to FIGS. 1(*a*)-(*d*), there is shown a board-type watercraft that is constructed according to the teachings of the present invention, the watercraft being identified generally by reference numeral 11. As will be explained in detail below, watercraft 11 is designed to be easily disassembled into a plurality of separate sections and, in turn, arranged into a highly compact stack that is suitable for storage or transport.

In the drawings, watercraft 11 is represented as a stand-up paddle board (SUP). However, it should be noted watercraft 11 is not limited to stand-up paddle boards. Rather, as defined herein, watercraft 11 represents any type of watercraft that would benefit from a modular construction for enhanced portability. In other words, the principals of the present invention could be similarly applied to alternative types of watercrafts, such as surfboards, kayaks, canoes and the like, without departing from the spirit of the present invention.

As can be seen, watercraft 11 has an elongated, board-like construction that includes a relatively flat top surface 13 designed to support a rider, a relatively flat, low friction, bottom surface 15, a narrow or pointed front end, or nose, 17 and a slightly widened rear end, or tail 19. In this assembled state, watercraft 11 closely resembles the look and feel of a conventional one-piece stand-up paddleboard, which is an object of the present invention.

Preferably, watercraft 11 is manufactured of a rigid and durable material that is particularly well suited for use in its designated environment. For instance, watercraft 11 may be shaped or molded using one or more materials that are conventionally used in the manufacture of board-type watercrafts, such a polyurethane foam core which is externally treated with a polyester or epoxy resin, or a suitable rigid plastic material including, but not limited to, polyethylene.

As shown in FIGS. 1(*b*) and 1(*d*), a fin-shaped recess 29 is preferably formed into bottom surface 15 towards tail 19. As can be appreciated, recess 29 is dimensioned to receive a fixedly mounted or spring-loaded fin (not shown), which is used for improved tracking and stability of watercraft 11 during routine use.

As noted briefly above, watercraft 11 is designed to be easily disassembled into a plurality of modules for ease of transport and storage. Specifically, watercraft 11 includes a plurality of individual sections 31 that are releasably secured together using multiple sets of compressive-type fastening mechanisms, or devices, 33.

Figures 2A, 2B, 2C:
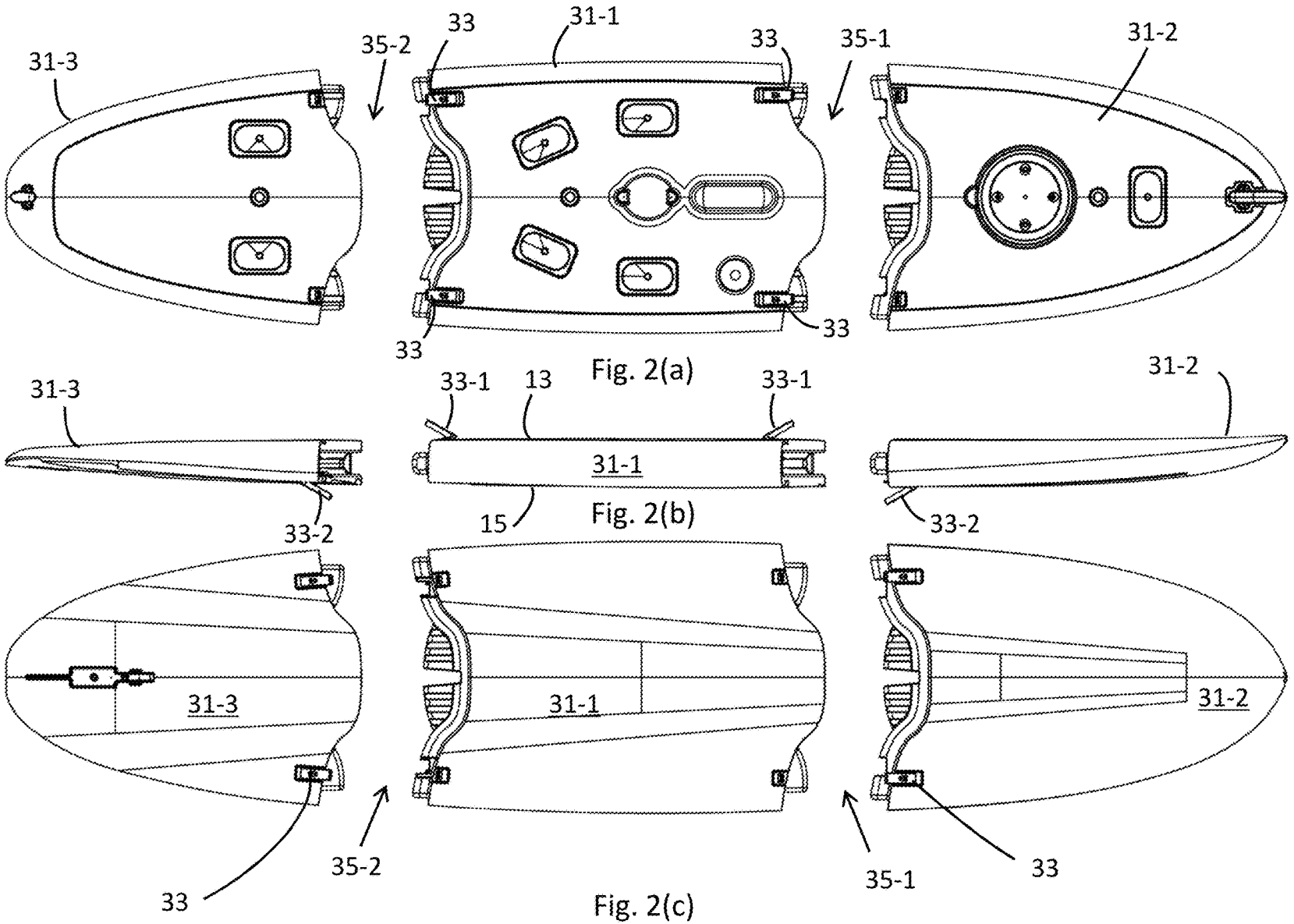
FIGS. 2(*a*)-(*e*) are exploded, top plan, front, bottom plan, top perspective and bottom perspective views, respectively, of the board-type watercraft shown in FIG. 1(*a*), the watercraft being shown in its disassembled state.

Referring now to FIGS. 2(*a*)-(*e*), watercraft 11 includes a middle, or center, section 31-1 that is releasably secured to both (i) a front, or nose, section 31-2 through a first connective region, or joint, 35-1, and (ii) a rear, or tail, section 31-3 through a second connective region, or joint, 35-2. As will be explained further in detail below, the particular design of sections 31 provides a number of notable advantages including, but not limited to, positioning joints 35 at low stress areas on watercraft 11 and affording greater design flexibility by using a universal center section 31-1 with varieties of different styles of nose and tail sections.

Adjacent sections 31 are designed to mate so as to produce joints 35 that are both strong and relatively seamless upon assembly. As seen most clearly in FIGS. 2(*d*) and 2(*e*), first end 37 of center section 31-1 is configured to matingly engage with first end 39 of nose section 31-2 through connective region 35-1. Specifically, first end 37 has an outwardly curved, generally U-shaped, face 41 that includes a center slot 43 and a pair of opposing, outwardly extending, side rails 45-1 and 45-2. Furthermore, first end 39 has an inwardly curved, complementary U-shaped face 47 that includes a center rail, or stiffening rib, 49 and a pair of opposing side slots 51-1 and 51-2. During assembly of watercraft 11, face 41 on center section 31-1 mates with face 47 on nose section 31-2, with center rail 49 fittingly protruding into center slot 43 and side rails 45-1 and 45-2 fittingly protruding into side slots 51-1 and 51-2, respectively. As such, a near seamless joint 35-1 is created with the requisite degree of stiffness due, at least in part, to the presence of rails 45 and 49.

In a similar fashion, second end 53 of center section 31-1 is configured to matingly engage with first end 55 of tail section 31-3 through connective region 35-2. Specifically, second end 53 has an inwardly curved, generally U-shaped, face 57 that includes a center rail, or stiffening rib, 59 and a pair of opposing side slots 61-1 and 61-2. Furthermore, first end 55 has an outwardly curved, complementary U-shaped face 63 that includes a center slot 65 and a pair of opposing, outwardly extending, side rails 67-1 and 67-2. During assembly of watercraft 11, face 57 on center section 31-1 mates with face 63 on tail section 31-3, with center rail 59 fittingly protruding into center slot 65 and side rails 67-1 and 67-2 fittingly protruding into side slots 61-1 and 61-2, respectively. As such, a near seamless joint 35-2 is created with the requisite degree of stiffness due, at least in part, to the presence of rails 59 and 67.

It should be noted that board-type watercraft 11 is not limited to the specific mating relationship between adjacent sections 31 described in detail above. Rather, it is to be understood that alternative mating means (i.e. other than the use of complementary rails and slots) could be used in place thereof without departing from the spirit of the present invention. Furthermore, it should be noted that additional structural elements, such as reinforcement ribs and/or deck contouring, may be integrated into one or more sections 31 to improve the overall rigidity of watercraft 11 through each joint 35.

As referenced briefly above, adjacent sections 31 are releasably secured together under substantial compressive force using multiple sets of fastening mechanisms 33. As can be appreciated, the number and arrangement of fastening mechanisms 33 serves to couple sections 31 together in such a manner so as to limit torque through each connective region 35. As a result, watercraft 11 has a stable construction upon assembly, which is a principal object of the present invention.

Figures 2D, 2E, 3, 4:
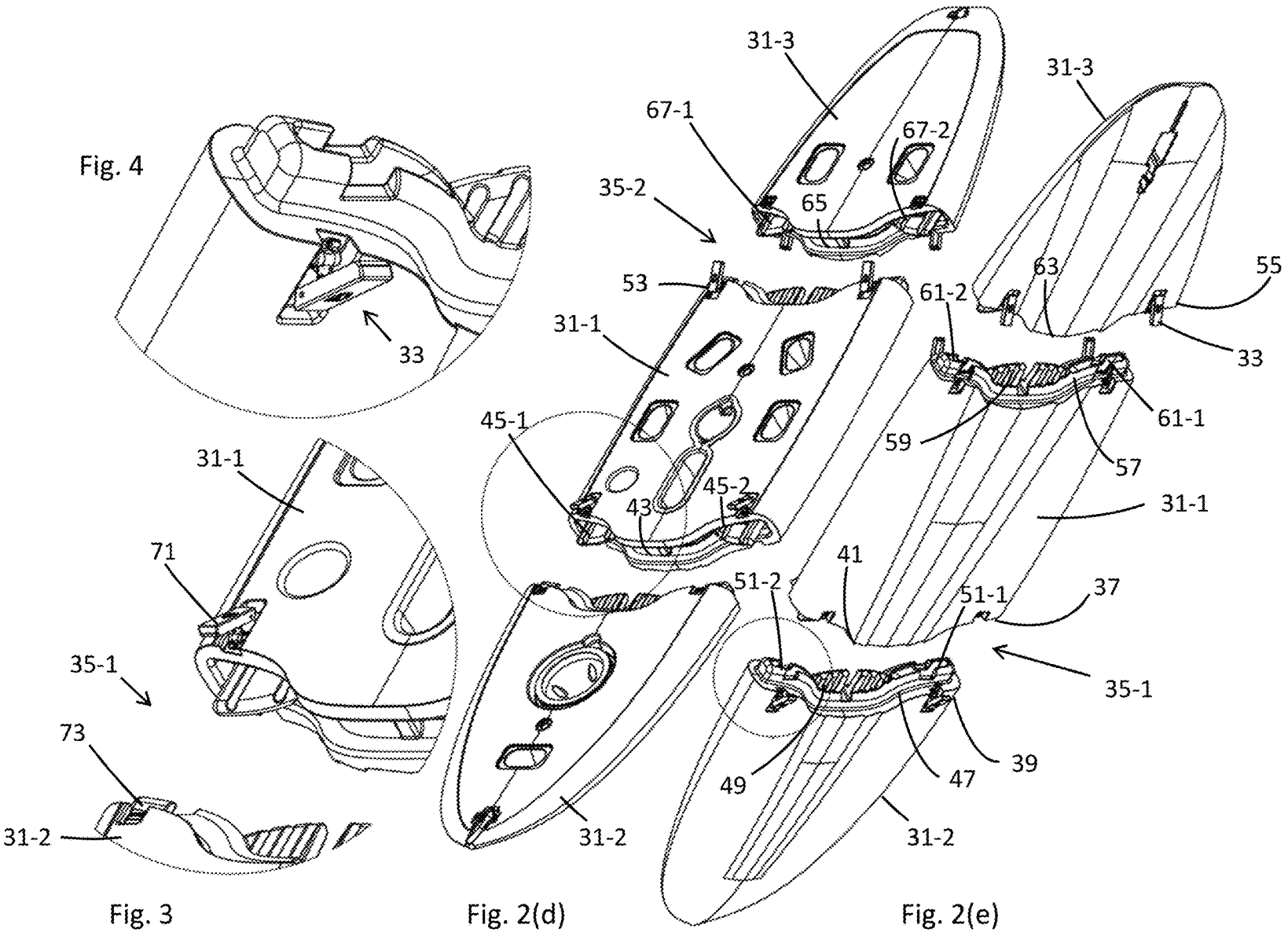
FIG. 3 is an enlarged, top perspective view of the circled region shown in the board-type watercraft of FIG. 2(*d*)
FIG. 4 is an enlarged, bottom perspective view of the circled region shown in the board-type watercraft of FIG. 2(*e*)

Referring now to FIGS. 3 and 4, each fastening device 33 is preferably in the form of a latch mechanism, or latch, which simply and reliably imparts a strong compressive force through its corresponding joint. As can be seen, each fastening mechanism 33 includes a latch arm 71 that is pivotally coupled to one module (e.g. middle section 31-1) and a complementary raised shoulder, or tab-like projection, 73 formed on an adjacent module (e.g. nose section 31-2) in direct linear alignment therewith.

Accordingly, through manual operation, latch arm 71 can be configured so as to clasp onto its complementary projection 73 and, in turn, be pivotally closed under considerable spring tension. As a result, the closed clasp establishes a significant compressive force between adjacent sections 31 and thereby forms a tight seal within the associated joint 35. At any time, latch arm 71 can then be pivoted open so as to disengage from the complementary projection 73 and thereby allow for dissociation of adjacent sections 31.

The incorporation of latch-type fastening mechanisms 33 is desirable due to their relative ease of use as well as the corresponding strength of the coupling force imparted therefrom. However, it is to be understood that alternative types of compressive-type fastening devices could be used in combination with or in place thereof without departing from the spirit of the present invention.

As mentioned above, the particular number and arrangement of latch-type fastening mechanisms 33 serve as principal novel features of the present invention. Most notably, as seen most clearly in FIG. 2(*b*), fastening mechanisms 33 are arranged on top and bottom surfaces 13 and 15 as vertically aligned pairs across each joint 35. In other words, each latch pair includes an upper fastening mechanism 33-1 on top surface 13 that is disposed above a lower fastening mechanism 33-2 on bottom surface 15 in vertical alignment therewith. By arranging fastening mechanisms 33 as vertically-aligned pairs on top and bottom surfaces 13 and 15 of watercraft 11, each joint 35 receives opposing compressive forces that limit torque upon assembly.

Altogether, four fastening mechanisms 33 are used to secure each joint 35, with a first vertically-aligned pair of latch mechanisms 33 disposed along one side of watercraft 11 and a second vertically-aligned pair of latch mechanisms 33 disposed along the opposite side of watercraft, as shown in FIGS. 2(*a*) and 2(*c*). The use of multiple pairs of vertically-aligned latch mechanisms 33 ensures proper rigidity through each joint 35 and, in addition, provides a certain degree of redundancy that renders watercraft 11 highly stable and reliable upon assembly.

As referenced above, the present invention relies upon pairs of latch mechanisms 33 that are preferably vertically aligned to ensure optimum rigidity through each joint 35. However, it is to be understood that, in certain applications, each pair of latch mechanisms 33 utilized to secure each joint 35 may require an offset relationship (e.g. as much as by 2-3 inches) to account for unique aspects relating to the shape and contour of the particular watercraft. In such situations, the offset relationship between each pair of latch mechanisms 33 does not compromise the effective distribution of compressive forces applied across each joint 35.

It is also to be understood that, as defined herein, each pair of latch mechanisms 33 utilized to secure each joint 35 may include more than two individual latch mechanisms 33 in substantial vertical alignment. For instance, each pair may represent an unequal number of opposing latch mechanisms 33 arranged in substantial vertical alignment (e.g. a single lower latch mechanism 33 disposed in vertical alignment between two upper latch mechanisms 33).

Preferred Stacked Arrangement of Disassembled Watercraft 11

As will be explained in detail below, watercraft 11 is capable of being dissembled and stacked in a highly compact configuration. In fact, when arranged as such, watercraft 11 is designed for packaging within a container that is compliant with maximum size standards established by most conventional ground courier services, such as UPS and FedEx.

Figure 5A:
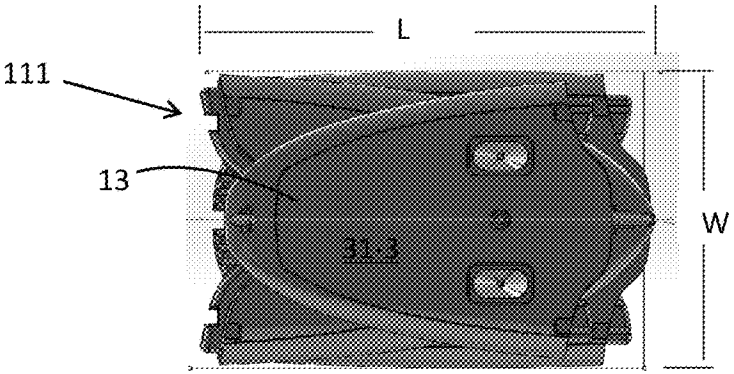
FIGS. 5(*a*) and 5(*b*) are top plan and front views, respectively, of the board-type watercraft shown in FIG. 1(*a*), the watercraft being shown in its disassembled state and arranged into a highly compact stack which is suitable for transport and storage.
Figure 5B:
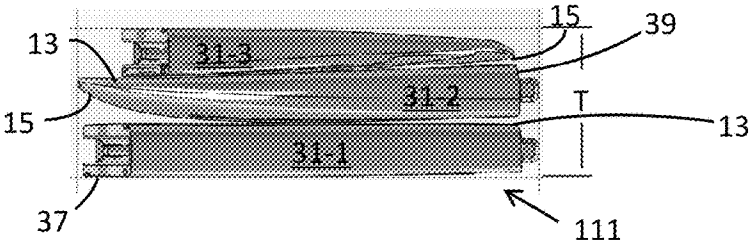
Figure 6:
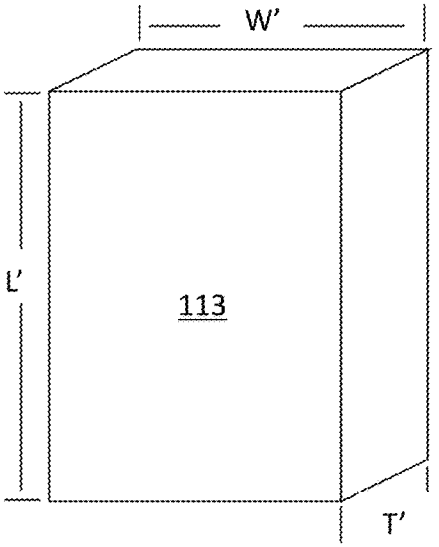
FIG. 6 is a top perspective view of a package suitable for retaining the disassembled and stacked watercraft shown in FIG. 5(*a*).

Specifically, referring now to FIGS. 5(*a*), 5(*b*) and 6, disassembled watercraft 11 can be arranged into an optimized stack 111 that is ideal for storage or shipment within a compact container, or package, 113. Optimized stack 111 is preferably created in the manner set forth in detail below.

Specifically, stack 111 is arranged by disposing middle section 31-1, with its top surface 13 facing up, as the bottom layer. Next, with its top surface 13 facing upward, nose section 31-2 is stacked directly on top middle section 31-1. In other words, bottom surface 15 of nose section 31-2 directly abuts against top surface 13 of middle section 31, with the distal end of nose section 31-2 positioned directly above first end 37 of middle section 31-1.

Finally, with its top surface 13 facing upward, tail section 31-3 is stacked directly on top of nose section 31-2. In other words, bottom surface 15 of tail section 31-3 directly abuts against top surface 13 of nose section 31-2, with the distal end of tail section 31-3 positioned directly above first end 39 of nose section 31-2. As seen most clearly in FIG. 5(*b*), the tapered thickness and slight curvature of nose section 31-2 and tail section 31-3 as well as the nested stack arrangement set forth in detail above serves to create an optimized stack 111 that is highly compact in nature, stack 111 being represented herein as having a length L, a width W and a thickness T.

Arranged as set forth above, stack 111 is designed to be fittingly inserted into a container 113 with a length L' of approximately 49.325 inches, a width W' of approximately 32.15 inches, and a thickness T' of approximately 16.125. In view of the aforementioned dimensions, container 113 is compliant with the maximum allowable shipping size allowed by conventional ground couriers, such as United Parcel Service of America, Inc., and FedEx Corporation. More specifically, package 113 satisfies maximum size restrictions that rely upon the following compliancy formula (in inches): (Width+Thickness)*2+Length<165.

Furthermore, it is to be understood that the limited-size stack 111 is appropriately dimensioned for transport within the interior of most conventional automotive vehicles. Specifically, it has been found that stack 111 can be fit within either (i) the backseat region of a full-size, extended bed truck, (ii) the backseat region of a compact, crew cab truck, (iii) the backseat region of a full-size sedan, or (iv) the cargo area of compact and full-size sport utility vehicles (SUVs).

Features and Advantages of the Present Invention

The particular design of board-type watercraft 11 introduces a number of notable features which, in turn, yield certain advantages over types of board-type watercrafts which are known in the art.

As a first feature, watercraft 11 relies upon a modular construction. As a result, watercraft 11 can be disassembled, as needed, for greater ease of transport (e.g. within most types of automobiles), shipment and storage.

As a second feature, watercraft 11 allows for design flexibility. In particular, it is to be understood that differently configured nose and tail sections can be used with a universal middle section to create a wide variety of different styles and models of boards using a limited number of molds, with each design closely resembling the look of a conventional one-piece board.

As a third feature, watercraft 11 is easy to assemble and disassemble, as needed. Specifically, the use of draw latches allows for assembly and disassembly of watercraft 11 with limited manual dexterity and without the need for additional tools.

As a fourth feature, watercraft 11 is rendered highly stable upon assembly. In particular, the use of complementary pairs of vertically-arranged draw latches on opposing surfaces of the board (i.e. in a top-to-bottom relationship) uniformly compresses adjacent sections together and thereby limits torque through each joint, thereby rendering the board highly stiff and stable. Additionally, the specific number and configuration of sections ensures that the joints are not located in certain regions of the board that typically receive the greatest amounts of stress (i.e. the center of the board where an operator commonly stands).

The embodiment shown above is intended to be merely exemplary and those skilled in the art shall be able to make numerous variations and modifications to it without departing from the spirit of the present invention. All such variations and modifications are intended to be within the scope of the present invention as defined in the appended claims.

What is claimed is:

1. A watercraft adapted for arrangement between an assembled state and a disassembled state, the watercraft comprising:

(a) a plurality of separate sections, the plurality of separate sections comprising first, second, and third sections with opposing, non-planar mating faces that are generally U-shaped in curvature from a first side to a second side, the first section comprising opposing ends, the second and third sections being joined to the opposing ends of the first section when the watercraft is in its assembled state, the first and second sections being joined together through a first joint when the watercraft is in its assembled state, the first and third sections being joined together through a second joint when the watercraft is in its assembled state; and (b) a plurality of compressive-type fastening elements for securing the first and second sections together when the watercraft is in its assembled state, the plurality of compressive-type fastening elements comprising a first pair of fastening elements arranged in substantial vertical alignment with one another;

(c) wherein an outwardly extending center rail is formed in the mating face of one of the first and second sections and is dimensioned to fittingly protrude into a center slot formed in the mating face of the other of the first and second sections when the watercraft is in its assembled state;

(d) wherein a pair of outwardly extending side rails is formed in the mating face of one of the first and second sections and is dimensioned to fittingly protrude into a corresponding pair of side slots formed in the mating face of the other of the first and second sections when the watercraft is in its assembled state;

(e) wherein, with the watercraft in its disassembled state, the first, second and third sections are adapted for arrangement into a stacked configuration, the stacked configuration having a length, a width and a height;

(f) wherein a first sum of the width and the thickness of the stacked configuration is multiplied by two to yield a product, a second sum of the product and the length of the stacked configuration being no greater than 165 inches.

2. The watercraft as claimed in claim 1 wherein, in its assembled state, the watercraft has a board-type construction that includes a top surface, a bottom surface, a front end, and a rear end.

3. The watercraft as claimed in claim 2 wherein the first pair of fastening elements includes a first fastening element located in the top surface of the board-type construction and a second fastening element located in the bottom surface of the board-type construction.

4. The watercraft as claimed in claim 3 wherein, with the watercraft in its assembled state, the first and second fastening elements are arranged in direct vertical alignment with one another.

5. The watercraft as claimed in claim 3 wherein, with the watercraft in its assembled state, the first and second fastening elements are vertically offset from one another by no greater than 3 inches.

6. The watercraft as claimed in claim 1 wherein the plurality of compressive-type fastening elements further comprises a second pair of fastening elements arranged in substantial vertical alignment with one another.

7. The watercraft as claimed in claim 6 wherein the first and second pairs of fastening elements are located along opposing sides of the watercraft in its assembled state.

8. The watercraft as claimed in claim 1 wherein each of the plurality of compressive-type fastening elements is in the form of a latch mechanism.

9. The watercraft as claimed in claim 8 wherein the latch mechanism includes a latch arm that engages a raised shoulder, the latch arm being pivotally coupled to the first section, the raised shoulder being formed on the second section.

10. The watercraft as claimed in claim 1 wherein the stacked configuration is adapted for transport within the interior of an automotive vehicle.

* * * * *